United States Patent [19]

Howes et al.

[11] Patent Number: 4,505,132

[45] Date of Patent: Mar. 19, 1985

[54] DISPLAY COOLER

[75] Inventors: James P. Howes, Fairfield; James E. Richardson, Weston, both of Conn.

[73] Assignee: J. P. Howes Productions, Westport, Conn.

[21] Appl. No.: 543,630

[22] Filed: Oct. 20, 1983

[51] Int. Cl.[3] ..... F25D 3/08

[52] U.S. Cl. ..... 62/457; 62/272; 62/530

[58] Field of Search ..... 62/457, 371, 372, 529, 62/530, 458, 463, 464, 272

[56] References Cited

U.S. PATENT DOCUMENTS

| | | | |
|---|---|---|---|
| 2,427,230 | 9/1947 | Salzmann | 62/457 X |
| 4,319,629 | 3/1982 | Hotta | 62/457 X |
| 4,324,111 | 4/1982 | Edwards | 62/530 X |
| 4,399,668 | 8/1983 | Williamson | 62/530 X |
| 4,441,336 | 4/1984 | Cannon | 62/457 |

*Primary Examiner*—Lloyd L. King

*Attorney, Agent, or Firm*—Louis H. Reens

[57] ABSTRACT

A display cooler is described formed of a self-supporting bin structure having a central cavity to hold products such as beverages and having upper located recesses sized to receive ice packs. The bin structure is formed of axially partitioned mating halves which form an externally cylindrical surface adapted to receive a display panel that is wrapped around the bin structure. The halves are held together with bands and a liner is employed inside the cavity. A drain is located at the bottom of the liner to enable removal of water condensed onto cool surfaces.

9 Claims, 8 Drawing Figures

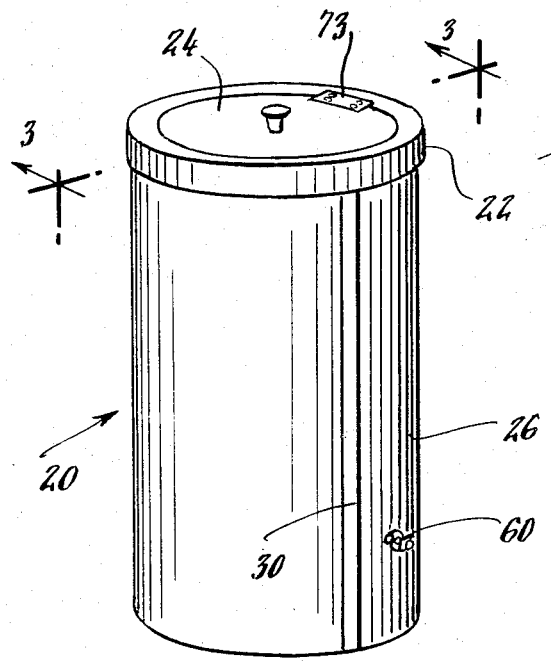
Fig. 1.
Fig. 2.
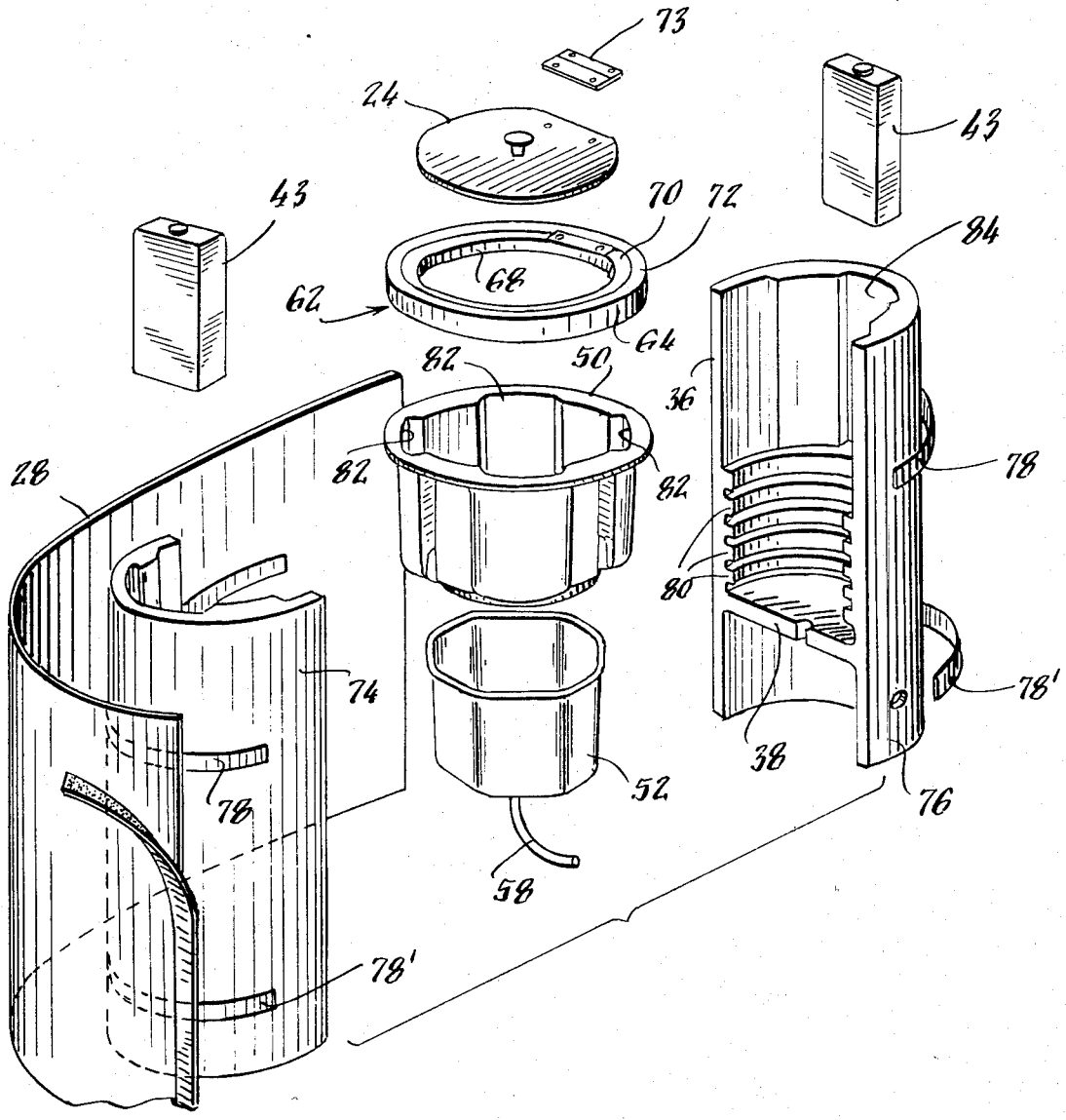

DISPLAY COOLER

FIELD OF THE INVENTION

This invention relates to a cooler for holding products such as beverages and the like.

BACKGROUND OF THE INVENTION

Coolers adapted to hold precooled ice packs are known in the art. One such device is shown in U.S. Pat. No. 4,344,301 to Taylor wherein the ice packs are placed in seats in opposing walls of a container. U.S. Pat. No. 4,319,629 shows a heating or cooling device mounted between opposing walls in a box. U.S. Pat. No. 4,292,817 shows ice packs positioned to divide the internal chamber of an ice box for cooling of bottles, each of which can be in direct contact with an ice pack.

SUMMARY OF THE INVENTION

With a cooler in accordance with the invention, a bin structure is employed that is relatively inexpensive to manufacture, convenient to assemble and use and adapted to receive various externally viewable displays such as advertising of a beverage or other product contained in the cooler. A cooler of this invention may, for example, be placed in any store location where customers can have convenient access, yet the products therein are kept cool with replaceable ice packs that can be regenerated when necessary by removing the ice packs from the bin and placing them in a freezer. The cooler need not be placed near an electrical outlet and avoids the messiness of melting ice.

A cooler in accordance with the invention is formed of a self-supporting bin structure made with an insulating body having a vertically oriented peripheral external wall to which a highly visible display can be conveniently affixed. The bin structure has a central cavity extending downwardly from the top of the body and is sized to contain a desired amount of food products such as beverage containers. The cavity is bounded by a peripheral side wall and a bottom wall with an upper part of the peripheral wall shaped to receive ice packs and a substantial portion of the cavity extending below the part of the peripheral wall adapted to receive the ice packs. Although an ice cooler of this invention is intended to be used dry, a drain is provided at the bottom wall to enable the removal of water as may condense onto cool surfaces in the cooler.

The floor area foot print occupied by the cooler can be kept low so as to enable it to be easily placed near store traffic patterns without being disruptive. The height of the cooler is made relatively high so as to impart a giant appearance with high visibility for the product therein with a display placed around the external surface.

As described herein for one embodiment for a cooler in accordance with the invention, the insulating body is formed of mating cylinder halves shaped to form the cavity and the walls. Bands are employed to hold the halves together and a liner is placed inside the cavity to form a liquid seal. The liner may be one piece or formed of an upper liner and a lower liner. The upper part of the liner is shaped to form peripheral recesses sized to receive ice packs. The lower part of the liner overlaps a portion of the upper liner and extends to the bottom wall to form a substantial cavity portion below the recesses where the ice packs are placed. A removable cover is provided with a downwardly extending edge over the outer surface of the insulating body and an inner retaining edge that extends into the cavity and retains the ice packs. The cover is provided with a transparent top door through which access to the cavity is obtained.

With a cooler in accordance with the invention, a substantial amount of products such as beverages can be stored and kept cool for long periods. The cooler is virtually maintenance free and conveniently adaptable to various different products and displays by replacing a display panel wrapped around the cooler.

It is, therefore, an object of the invention to provide a display cooler for products such as beverages wherein the cooler can be conveniently placed at a favorable location for improved sales while maintaining the products cold for long time periods.

These and other objects and advantages of the invention can be understood from the following detailed description of a cooler in accordance with the invention and described in conjunction with the drawings.

BRIEF DESCRIPTION OF DRAWINGS

FIG. 1 is a perspective view of a cooler in accordance with the invention;

FIG. 2 is a perspective exploded view of the cooler of FIG. 1;

DETAILED DESCRIPTION OF DRAWINGS

Figure 3:
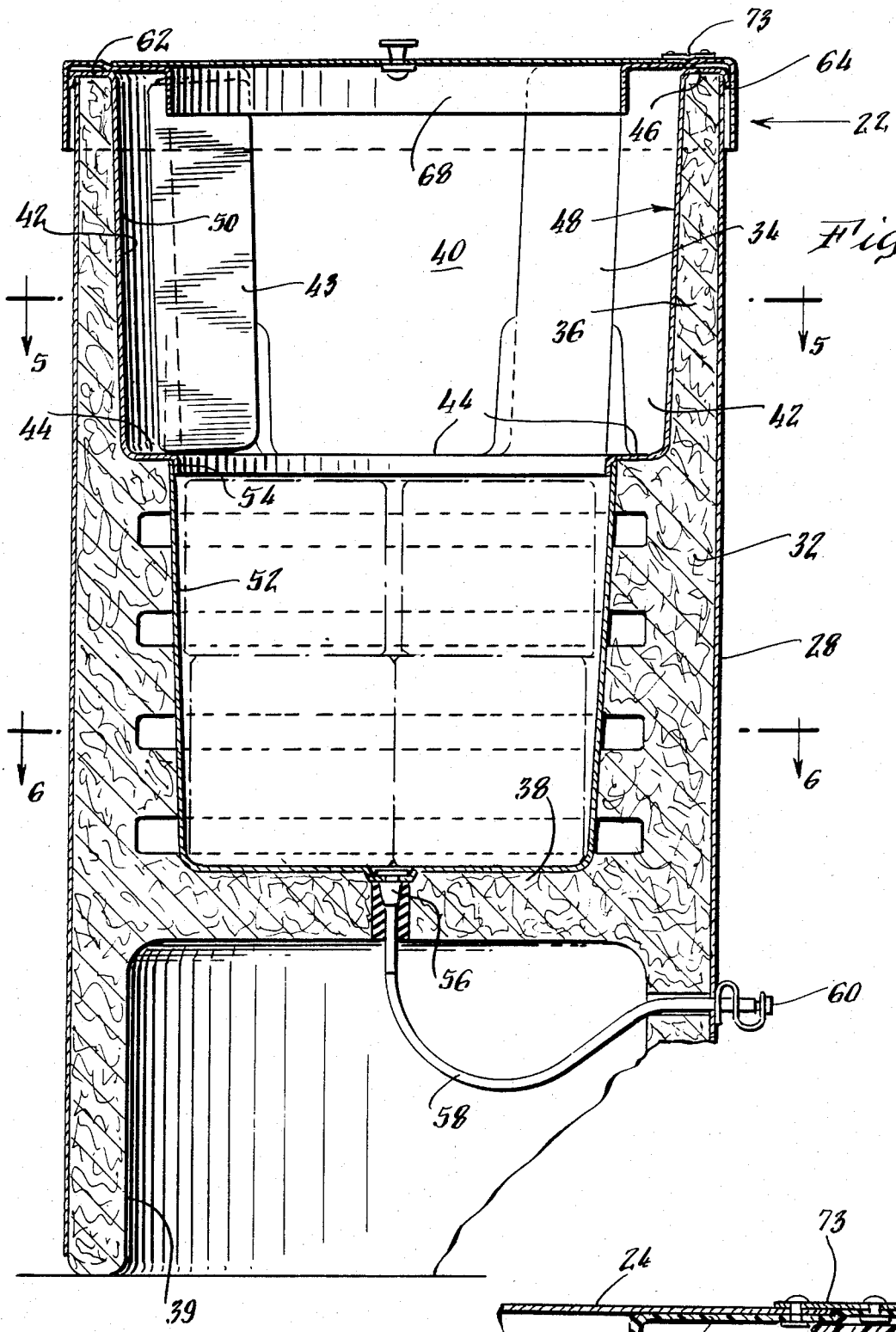
FIG. 3 is an enlarged partial vertical section view of the cooler of FIG. 1.

With reference to FIGS. 1 and 2, a cooler 20 is shown formed of a cylindrical bin structure with a removable cover 22 having a door 24. The cooler 20 has an upright peripheral surface 26 around which a removable display material 28 can be wrapped and held thereto with a tape 30 and the cover 22.

The cooler 20 bin structure as shown in FIG. 3 is formed with a cylindrical insulating bin structure 32 formed of an insulating material such as styrofoam or other rigid insulating material that is capable of standing self-supported on the floor while retaining a substantial quantity of products inside a centrally located cavity 34. The cavity 34 has a peripheral wall 36 and bottom wall 38 with an upper part 40 of the cavity having in wall 36 peripherally located recesses 42 sized to receive and vertically support removable ice packs 43 on horizontal shelves 44. The bottom wall 38 is spaced above a lower cylindrical support structure 39.

The cavity 34 extends from the top 46 of the bin structure 32 where cover 22 overlies the cavity and has a liner 48 which extends down from the top to cover the surface of the cavity 34. Liner 48 is formed of an upper part 50 and lower section 52 which externally overlaps a downwardly extending lip 54 of the upper part 50 so that condensed liquid can collect at the bottom wall 38. A drain 56 is centered in bottom wall 38 and sealingly affixed to liner section 52 to drain condensed liquid away through a tube 58 when a stop 60 is opened.

Figure 4:
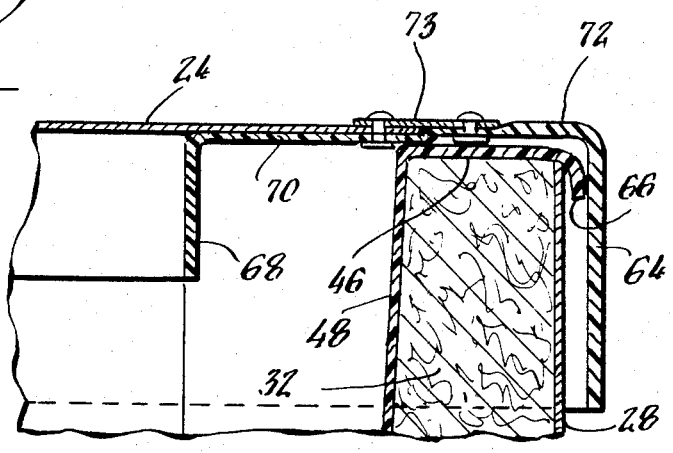
FIG. 4 is an enlarged partial section view of an upper right top portion of the cooler shown in FIG. 3.

The cover 22 is formed with a peripheral annual rim 62 having an external downwardly extending edge 64 that covers the top edge of display wrap 28 as more clearly seen in FIG. 4. The liner part 50 extends over the top edge of the bin structure 32 with a depending lip 66 located inside cover edge 64.

Rim 62 also has an inwardly located downwardly extending retaining edge 68 that is so spaced from peripheral wall 36 so as to retain ice packs placed on shelves 44 in recesses 42. The rim edge 68 extends from a horizontal section 70 that is sufficiently vertically and downwardly displaced from an outer horizontal rim section 72 so that door 24, when in place, can effectively form an upper flush appearance for cover 22. Door 24 is preferably made of a transparent plastic material that is affixed to rim 62 with a hinge 72.

As illustrated in FIG. 2, the bin body structure 32 is formed of a pair of mating axially partitioned cylindrical halves 74, 76 that are joined and held together by a pair of cylindrical bands 78, 78'. The halves 74, 76 are formed of molded foam materials which define the peripheral wall 36 and bottom wall 38 when mated together to form the cylindrical bin structure 32. Horizontal ribs 80 are used to improve the rigidity of the structure. The liner 48 liquid seals the axial seam between the halves.

The liner parts 50 and 52 are shown to fit respectively in the upper part and lower section of the bin structure and are made of thermoplastic materials. The upper liner part 50 is molded to form ice pack recesses 42 with wall portions such as 82 that fit in corresponding recesses 84 of the upper part of the foam bin structure 32.

Figure 5:
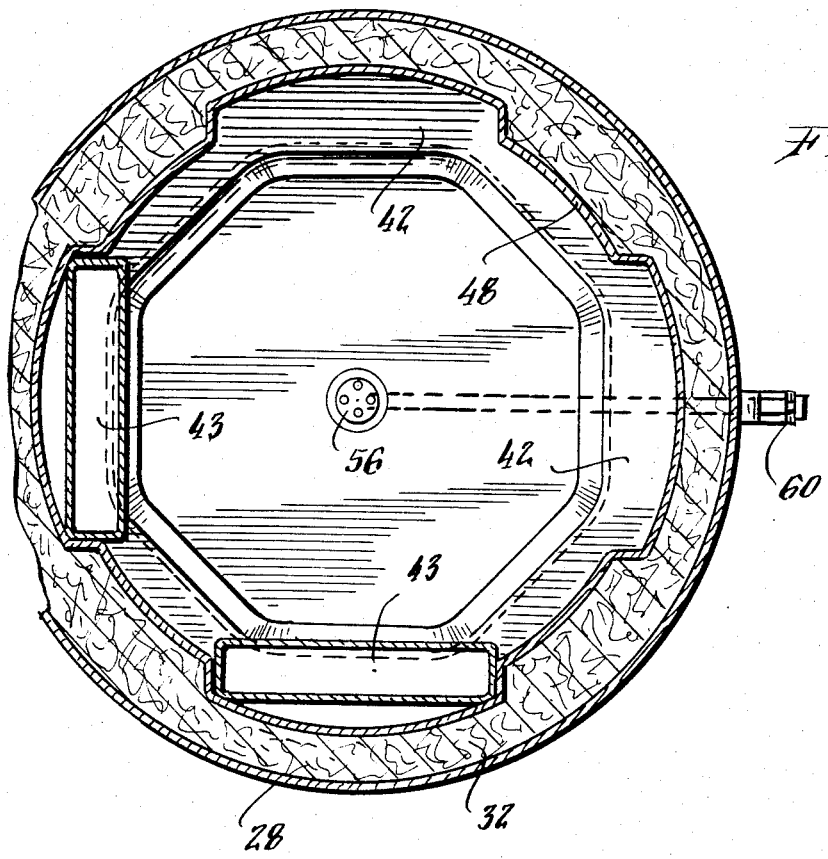
FIG. 5 is a horizontal section view of the cooler of FIG. 1 taken along the line 5—5 in FIG. 3.
Figure 6:
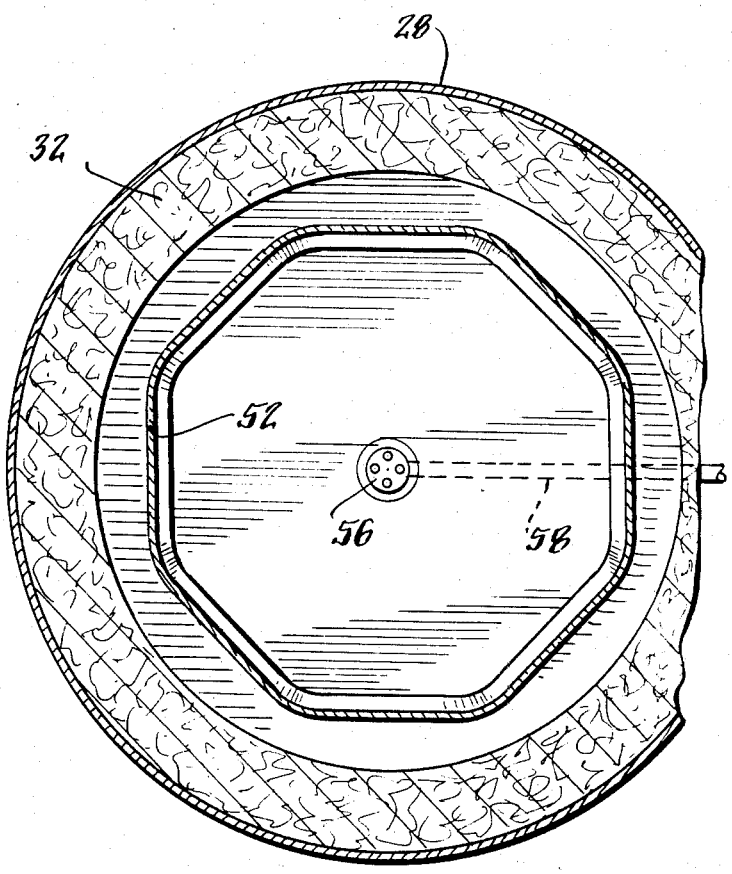
FIG. 6 is a horizontal section view of the cooler of FIG. 1 taken along the line 6—6 in FIG. 3.

The cooler 20 has a bin structure that occupies a small floor area, generally less than two feet square. The bin structure has, as shown in FIG. 5, four ice pack retaining recesses 42, each of which can hold four pound ice packs 43. With a structure 32 that is about three feet high and about 20 inches in diameter a cooler cavity 40 is provided of about 12 inches diameter and 24 inches deep, capable of holding about 96 twelve oz. beverage units. These can be kept cool, generally between about 40° to 50° F. for about eight hours in a room having an ambient temperature of about 90° degrees, even while the door 22 is repeatedly opened. A substantial part, about 50 percent, of the cavity 40 extends below the shelves 44 on which the ice packs 43 are located.

Figure 7:
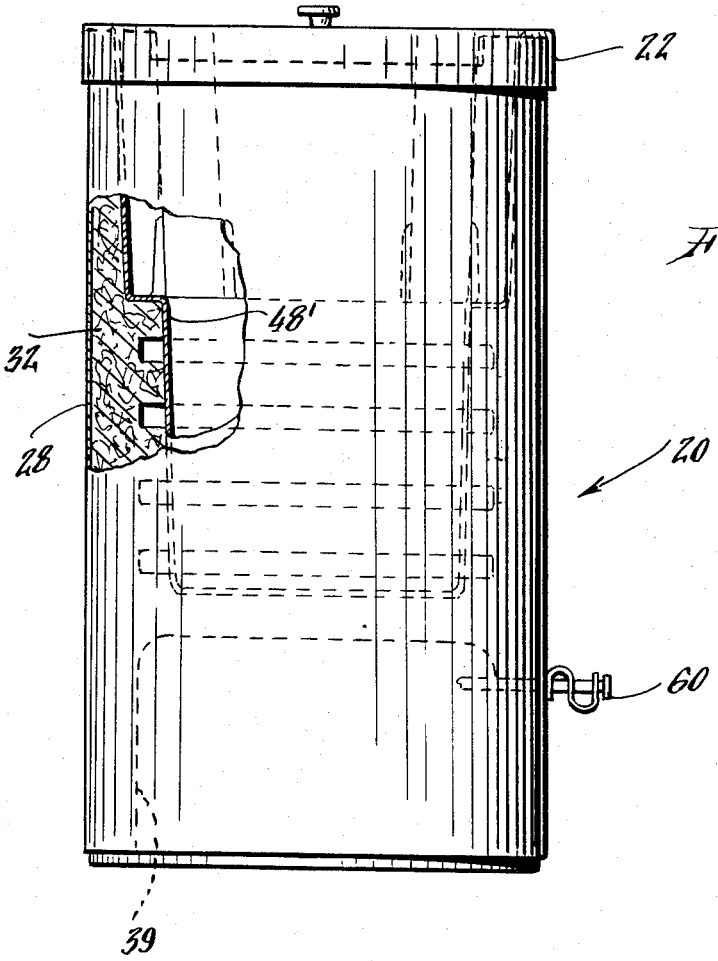
FIG. 7 is an elevation view of a cooler in accordance with the invention with a portion cut away to reveal a liner used therein.
Figure 8:
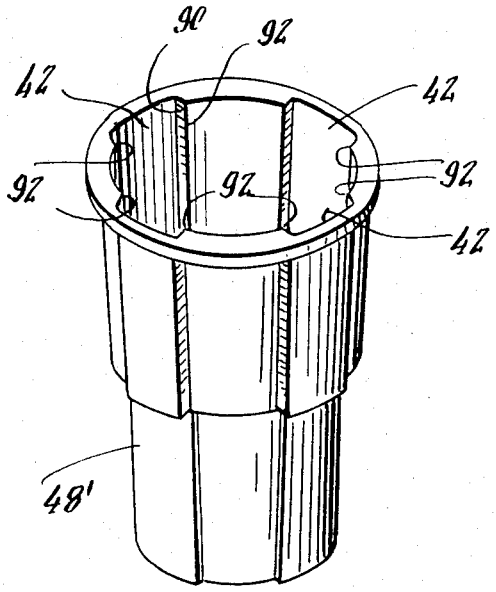
FIG. 8 is a perspective view of a liner employed in the cooler as shown in FIG. 7.

FIGS. 7 and 8 show a cooler 20 in accordance with the invention wherein a liner 48' is formed of a single molded piece. The recesses 42 formed in the upper part of liner 48' have side walls 90 with end edges 92 that are shaped so as to retain an ice pack placed in a recess 42 without requiring the use of depending edge 68 of cover 22 as shown in FIG. 4.

Having thus described a cooler in accordance with the invention, its advantages can be appreciated. Variations from the described embodiment can be made without departing from the scope of the claims. For example, the peripheral external display surface may be rectangular rather than cylindrical.

What is claimed is:

1. A cooler comprising:

a hollow self-supporting low footprint relatively high bin structure formed of an upright insulating material and having a vertically oriented peripheral external wall adapted to receive display material and having a central cavity sized to retain products to be cooled and extending downwardly from the top of the bin structure with the cavity being bounded by a peripheral side wall and a bottom wall, said peripheral side wall being shaped at an upper part to support ice packs, with a substantial portion of the cavity extending below said upper part of the side wall, said bin structure being formed of multiple mating segments, which form said peripheral and bottom walls, means for holding said segments together, and liner means placed in the cavity formed by the held together segments.

2. A cooler comprising:

a hollow self-supporting low footprint relatively high bin structure formed of an upright insulating material and having a vertically oriented peripheral external wall adapted to receive display material and having a central cavity sized to retain products to be cooled and extending downwardly from the top of the bin structure with the cavity being bounded by a peripheral side wall and a bottom wall, said peripheral side wall being shaped at an upper part to support ice packs with a substantial portion of the cavity extending below said upper part of the side wall, the bin structure being formed of a pair of mating hollowed-out halves, each of which forms a portion of the peripheral and bottom walls, means for holding said halves together, and liner means placed in the cavity by the held-together halves.

3. The cooler as claimed in claim 2 wherein said liner means comprises:

an upper liner placed to fit into an upper portion of the bin structure cavity and shaped to form recesses sized to receive the ice packs and having a lower annular depending liquid drain lip;

a lower liner placed to fit into a lower portion of the bin structure cavity and having an upper edge located radially externally of the liquid drain lip of the upper liner so that liquid dripping from the upper parts of the cavity are collected at the bottom of the lower liner.

4. The cooler as claimed in claim 2 and further including means for draining away condensed liquid accumulated in the cavity, said drain means being sealingly affixed to the liner means.

5. A cooler comprising:

a hollow self-supporting low footprint relatively high bin structure formed of an upright insulating material and having a vertically oriented peripheral external wall adapted to receive display material and having a central cavity sized to retain products to be cooled and extending downwardly from the top of the bin structure with the cavity being bounded by a peripheral side wall and a bottom wall, said peripheral side wall being shaped at an upper part to support ice packs, with a substantial portion of the cavity extending below said upper part of the side wall, said peripheral side wall being shaped at an upper part to form recesses shaped to receive and support ice packs, with a substantial portion of the cavity extending below said upper part of the side wall, a removable cover sized to overlie the top of the bin structure and having an external depending edge located to fit around the outside periphery of the top of the bin structure and an inner depending retainer edge located to fit inside the top opening of the cavity so as to retain ice packs placed in said recesses, said cover being provided with a liftable door overlying said cavity opening.

6. The cooler as claimed in claim 5 wherein the bin structure is cylindrical in shape.

7. The cooler as claimed in claim 2 wherein the mating halves are half cylindrical in external shape.

8. The cooler as claimed in claim 2 wherein the liner is formed of a single molded part.

9. A display cooler comprising:

a hollow self-supporting low-footprint bin structure formed of an upright molded foam insulating material and having a vertically oriented cylindrically shaped peripheral surface to receive display material and further having a generally cylindrical central cavity extending from a top of the bin structure, said bin structure being formed of a pair of axially partitioned, externally cylindrical mating halves, means for holding the halves together, and liner means placed in the cavity to liquid seal the seam formed between the held-together halves, said bin structure being so shaped at an upper part of the cavity so as to provide recesses shaped to receive and vertically support ice packs used to cool products placed in the cavity, cover means placed over the top of said bin structure and having a door for access to the cavity, said cover means including a peripheral rim overlying an upper portion of the external surface, and a display panel wrapped around the bin structure and having an upper part thereof radially inwardly of the rim of the cover means.

* * * * *